US005874877A

United States Patent [19]

Kawashima et al.

[11] Patent Number: 5,874,877

[45] Date of Patent: Feb. 23, 1999

[54] CIRCUIT BREAKER

[75] Inventors: Yoshiaki Kawashima; Kazuhiko Satoh; Tadahisa Aoki; Makoto Ogasawara, all of Tochigi, Japan

[73] Assignee: Fuji Electric Co., Ltd., Kawasaki, Japan

[21] Appl. No.: 902,582

[22] Filed: Jul. 29, 1997

[30] Foreign Application Priority Data

Aug. 6, 1996 [JP] Japan ..... 8-223070

[51] Int. Cl.[6] ..... H01H 67/02

[52] U.S. Cl. ..... 335/132; 335/202

[58] Field of Search ..... 335/18, 121–132, 335/202; 361/42–51; 200/295–305

[56] References Cited

U.S. PATENT DOCUMENTS 5,218,332 6/1993 Blanchard et al. ..... 335/132

5,231,365 7/1993 Kato ..... 335/202

5,576,676 11/1996 Koller et al. ..... 335/132

*Primary Examiner*—Lincoln Donovan

*Attorney, Agent, or Firm*—Kanesaka & Takeuchi

[57] ABSTRACT

A circuit breaker with a completely electromagnetic type overcurrent tripping device has a flexibility for changes in the production schedule of the overcurrent tripping device. An overcurrent tripping device for each pole is integrally housed in a common unit case, which is then inserted into a case of the circuit breaker. In this case, a yoke of the overcurrent tripping device is combined with an oil dash pot inserted into a coil, and the combined parts are pressed and fixed in the unit case without soldering. Thus, the coil, which is changed depending on the rated current, and the yoke and oil dash pot which are common products, can be separately stored prior to assembly, thereby enabling flexible responses to changes in the production schedule. In addition, the yoke and the oil dash pot need not be soldered and are fixed individually to the unit case, thereby reducing the number of assembly operations.

8 Claims, 7 Drawing Sheets

CIRCUIT BREAKER

BACKGROUND OF THE INVENTION AND RELATED ART STATEMENT

The present invention relates to a circuit breaker, such as a wiring breaker or an earth leakage breaker, in which a switch mechanism and an overcurrent tripping device are incorporated in a molded container, and in particular, to a circuit breaker with a completely electromagnetic type overcurrent tripping device.

FIG. 12 is a vertical cross sectional view of a conventional example of a three-pole circuit breaker (earth leakage breaker). In FIG. 12, the circuit breaker is integrally formed in a molded container consisting of a case 1 and a cover 2. In the ON-condition of the circuit breaker as shown in the figure, a current path is formed of a fixed contact 4 integral with a power terminal 3; a movable contact 5 that contacts the fixed contact 4 via a fixed contact point 4*a* and a movable contact point 5*a*; a flexible lead 6, one end of which is connected to the movable contact 5 by spot welding; a lead plate 7 to which the other end of the lead 6 is connected by spot welding; a relay plate 9 to which the lead plate 7 is tightened with a screw 8; a coil 11 of the overcurrent tripping device 10, one end of which is connected to the relay plate 9 by soldering; and a load terminal 12 to which the coil 11 is connected by soldering. The lead for each pole penetrates through a zero-phase current transformer (ZCT) 13, and causes a secondary output to be produced in the ZCT 13 when a leakage occurs. A leakage detection circuit for amplifying the secondary output to output a tripping signal is mounted on a print board 14, and a power line 15 from the print board is spot-welded to the lead plate 7 together with the lead 6.

The movable contact 5 is rotatably retained at the right end of FIG. 12, and subjected to a clockwise force by a contact spring 16 formed of a compression spring, while the movable contact 5 is also pressed downward onto the fixed contact 4 by a switch mechanism 17. The switch mechanism 17 is explained in brief. The switch mechanism 17 comprises a handle 19 supported by the case 1 via a support shaft 18; a link 20 to which one end of an arm 19*a* of the handle 19 is coupled; a pressing rod 21, one end of which is connected to the other end of the link 20 and the other end of which contacts the movable contact 5 and is guided in a vertical sliding motion, as in FIG. 12, along a groove in the case 1; a latch 22, one end of which is coupled to the support shaft 18; and a link 23 that connects the latch 22 and the link 20 together.

In the condition that the circuit breaker is turned on as shown in the figure, the link 20 is subjected to a clockwise rotating force via the pressing rod 21 under the force of the contact spring 16, while the latch 22 is simultaneously subjected to a clockwise rotating force via the link 23, with its tip locked by a claw 24*a* of a trip bar 24 to prevent its rotation. The trip bar 24 is rotatably supported by the case 1 via an insulating bar 24*b* that extends over each pole, and a tripping arm 24*c* is provided so as to correspond to the overcurrent tripping device 10 for each pole. The claw 24*a* is integrally installed opposite to the tripping arm 24*c* of a central pole.

FIG. 13 is a side view for showing the completely electromagnetic type overcurrent tripping device 10. In FIG. 13, an oil dash pot 26 inserted into the coil 11 is coupled by soldering to one leg of a yoke 25 formed of a magnetic plate bent like the character "L" in such a way that the oil dash pot penetrates through the yoke 25, with an armature 27 rotatably supported by the tip of the other leg of the yoke. The armature 27 is held by a return spring 28 installed between the armature 27 and the yoke 25 as shown in the figure, and is opposed to an electromagnetic pole 29 at the head of the oil dash pot 26. One end of the coil 11 penetrates through the yoke 25 and is soldered to the relay plate 9, whereas the other end is soldered to the load terminal 12. The oil dash pot 26 adjusts a tripping operation time in a well known manner, and comprises a non-magnetic cylinder, in which an oil is filled and in which a plunger is sealed together with a braking spring.

The main circuit section of the circuit breaker is assembled as follows. The lead 6 is connected to the movable contact 5, and the lead plate 7 with the power line 15 connected thereto is connected to the other end of the lead 6. The movable contact 5 is installed into the case 1 with the fixed contact 4 attached thereto, the lead 6 is passed through the ZCT 13, and the lead plate 7 is fitted and held in a groove (not shown) in the case 1. Then, the relay plate 9 of the overcurrent tripping device 10 assembled as shown in FIG. 13 is placed on the lead plate 7, and the screw 8 is applied in a screw hole (not shown) in the relay plate 9 through a through hole (not shown) in the lead plate 7. The screw 8 is tightened from the bottom of the case 1 (the bottom of FIG. 12) via a window hole (not shown). The other end of the power line 15 is subsequently soldered to the print board 14.

In this circuit breaker, when the tip 19*b* of the handle 19 is rotated from the ON state shown in FIG. 12 to the position shown by the broken line, the pressing rod 21 is raised via the link 20 to cause the movable contact 5 to be opened to the position shown by the broken line, under the action of the contact spring 16, i.e. OFF operation.

On the other hand, when a main circuit current becomes excessive and thus the armature 27 is attracted to the electromagnetic pole 29, the trip bar 24 is rotated in a counterclockwise direction via the tripping arm 24*c*, thereby releasing the latch 22 locked by the claw 24*a* to rotate the latch in the clockwise direction. Consequently, the link 23 is displaced to the position shown by the broken line, while the pressing bar 21 is simultaneously raised to open the movable contact 5 (tripping operation). If leakage occurs to cause the main circuit current to become unbalanced, a secondary output is generated by the ZCT 13, causing a tripping signal to be sent out from the earth leakage detection circuit to a tripping coil unit (not shown). The tripping coil unit causes the trip bar 24 to be driven to generate a tripping operation.

These conventional circuit breakers have the following problems.

(1) The coil of the overcurrent tripping device is changed depending on the rated current. Since, however, the yoke and the oil dash pot are soldered and coupled together via the coil, the use of the yoke and oil dash pot common to different rated currents is limited by the coil (the rate current), resulting in an inflexible production schedule.

(2) Since the overcurrent tripping device is screwed and fixed to the case for each pole, a large amount of time and labor is required to assemble the circuit breaker.

(3) Since the main circuit conductor or lead is disposed in the lower part of the overcurrent tripping device, it must be connected to an overcurrent tripping device from the rear side of the case, thereby degrading workability. Connection of the power line to the earth leakage detection circuit also degrades workability.

It is thus an object of this invention to solve these problems by providing a circuit breaker incorporating in a molded container formed of a case and a cover, a switch mechanism; and an overcurrent tripping device that acts on a latch for the switch mechanism to generate a tripping operation and in which an oil dash pot inserted into a coil is combined with an L-shaped yoke supporting an armature and a return spring.

SUMMARY OF THE INVENTION

According to a first aspect of the invention to solve the problems in (1) and (2), a unit case that integrally houses an overcurrent tripping device for each pole is provided, and a yoke and an oil dash pot of the overcurrent tripping device for each pole are individually pressed and fixed in the unit case, which can be inserted into a case of a circuit breaker for assembly.

Since the yoke and the oil dash pot are individually pressed and fixed in the unit case to define their inter-locational relationship, the yoke and the oil dash pot need not be soldered together. Thus, the yokes, oil dash pots and coils may be separately stored prior to assembly, and assembled depending on a current specification, so that the stock of common parts can be reduced compared to the conventional method in which different assemblies must be stored for different rated currents.

In addition, since the overcurrent tripping device is integrally housed in the unit case, for example, the overcurrent tripping devices for three poles can be pressed and fixed in the unit case outside the case of the circuit breaker, and all of these devices can then be incorporated in the case at one time. Thus, the circuit breaker can be assembled more easily as compared to the conventional method in which the individual overcurrent tripping devices must be screwed and fixed into place.

A circuit breaker according to a second aspect of the invention is based on the first aspect of the circuit breaker, wherein a latch receiver for locking the latch for the switch mechanism and a trip bar with which the latch receiver is engaged are supported by the unit case of the overcurrent tripping device. Under the conventional techniques, the latch receiver and the trip bar have been supported by, for example, a frame for the switch mechanism or the body case of the circuit breaker, and are separated from the overcurrent tripping device. According to this invention, however, the latch receiver and the trip bar are supported by the unit case, which also supports the overcurrent tripping device. This arrangement improves the locational accuracy of the overcurrent tripping device between the armature and the trip bar and between the latch receiver and the trip bar, resulting in a stable tripping characteristic.

According to a third aspect of the invention, to solve the problem in (3), a main circuit conductor is displaced on the unit case in which the overcurrent tripping device is housed. This allows the main circuit conductor to be connected to the overcurrent tripping device from above the case of the circuit breaker, thereby improving the workability and enabling spot welding within an assembly line. It also enables a power line for obtaining power supply from the main circuit to be connected easily to an earth leakage detection circuit.

In the above circuit breaker according to a fourth aspect of the invention, one end of a lead is connected to a movable contact, while the other end is connected to a relay terminal, which is fitted and held in the unit case of the overcurrent tripping device. The other end of the lead is connected within an assembly line to one end of the coil of the overcurrent tripping device or to one end of the main circuit conductor penetrating through a ZCT. Due to the flexibility of the lead, the position of its connected end is unstable, preventing the lead from being connected easily. In the invention, the position of the connected end of the lead can be made stable to enable easier connecting operations by fitting and holding in the unit case a relay terminal connected beforehand to the other end of the lead and connecting the relay terminal to one end of the coil of the overcurrent tripping device or one end of the main circuit conductor penetrating through the ZCT.

A circuit breaker according to a fifth aspect is based on the fourth aspect of the circuit breaker, wherein a part of the relay terminal is directly coupled to a power terminal section of a print board with the earth leakage detection circuit mounted thereon. This eliminates the need for a separate power line to connect the main circuit and the power terminal together and also enables the print board to be mechanically retained by the relay terminal.

DETAILED DESCRIPTION OF PREFERRED EMBODIMENTS

Figure 1:
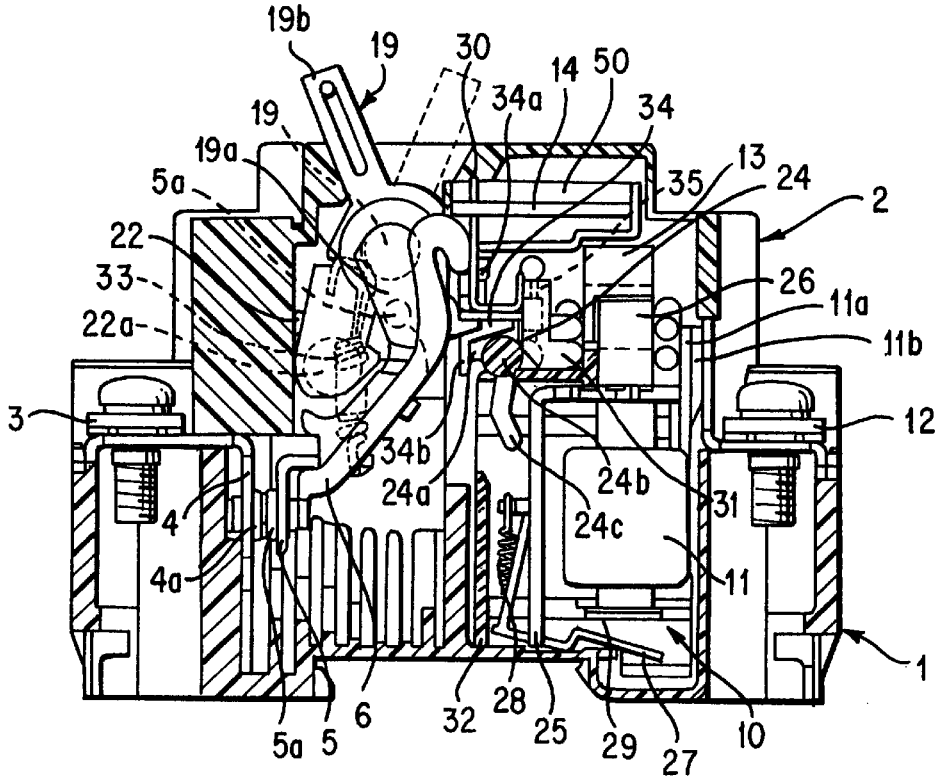
FIG. 1 is a vertical cross sectional view of a circuit breaker (earth leakage breaker) showing one embodiment of the invention.
Figure 2:
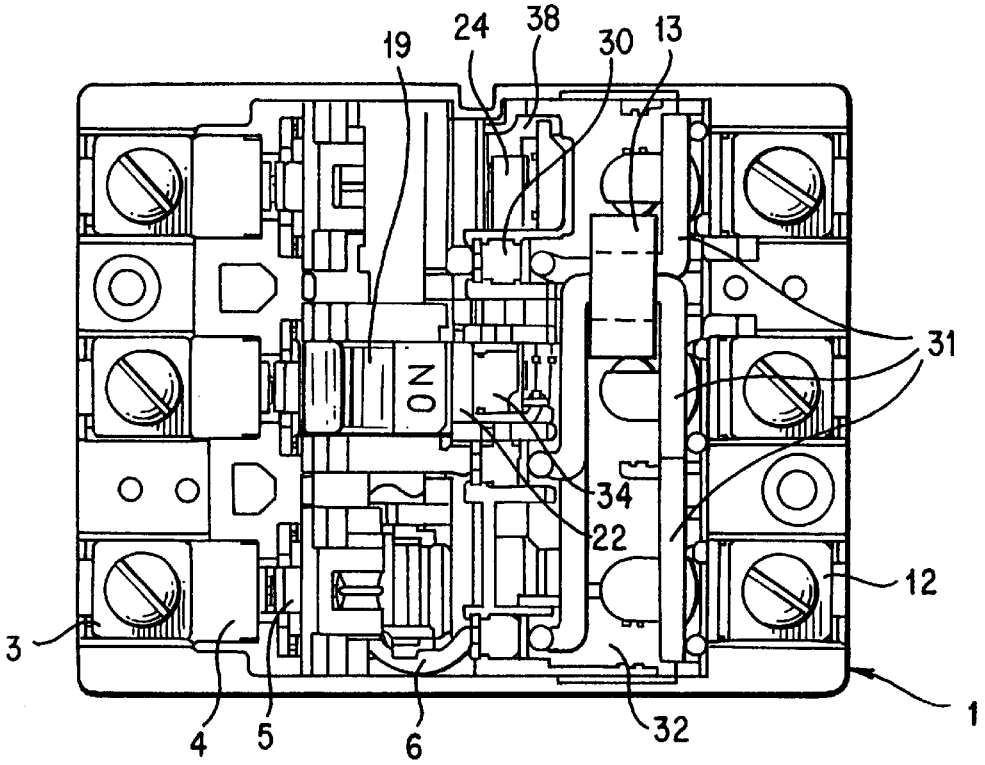
FIG. 2 is a plan view of the circuit breaker in FIG. 1.

An embodiment of this invention is described below with reference to FIGS. 1 to 11. The components which correspond to the above conventional example have the same reference numerals. FIG. 1 is a vertical cross sectional view showing the "On" state of a three-pole circuit breaker formed as an earth leakage breaker, and FIG. 2 is a plan view of FIG. 1.

The circuit breaker comprises a switch mechanism section and an overcurrent tripping device that are housed in a molded container formed of a case 1 and a cover 2. In FIG. 1, a current path is formed of a fixed contact 4 with a power terminal 3 integrally formed at one end; a movable contact 5 contacting the fixed contact 4 via a fixed contact point 4*a* and a movable contact point 5*a*; a flexible lead 6, one end of which is connected to the movable contact 5; a relay terminal 30 to which the other end of the lead 6 is connected; a primary conductor 31, one end of which is connected to the relay terminal 30; a coil 11 of an overcurrent tripping device 10, one end of an extension line 11*a* thereof being connected to the primary conductor 31; and a load terminal 12 with the other extension line 11*b* from the coil 11 being connected thereto, in this order.

The overcurrent tripping device 10 is a completely electromagnetic type, wherein an oil dash pot 26 inserted into the coil 11 is combined with an L-shaped yoke 25, and an armature 27 is attached to the yoke 25 so as to be opposed to an electromagnetic pole 29 at the head of the oil dash pot 26. The armature 27 is maintained in the position shown in the figure by a return spring 28 extending between the armature 27 and the yoke 25. The overcurrent tripping device 10 for each pole is housed and retained in a unit case 32 common to each pole, and then incorporated in a case 1 via the unit case 32. A primary conductor 31 penetrates through a ZCT 13, which is disposed and retained on the case 32.

The movable contact 5 is rotatably coupled to the tip of an arm 19*a* of a handle 19 via a protruding shaft 5*a*. The handle 19 is rotatably supported by a bearing notch in the case 1 via an integral supporting shaft 19*c* and retained by the cover 2. A switch spring 33 formed of a tensile coil spring extends between the movable contact 5 and the latch 22, and the movable contact 5 is subjected to a rotational force in the clockwise direction (as shown in the figure) caused by the tension of the switch spring 33 while the protruding shaft 5*a* is used as a supporting point. The movable contact 5 is thus pressed against the fixed contact 4. The latch 22 is rotatably supported by the bearing notch in the case 1 via the supporting shaft 22*a* and retained by the cover 2.

Figure 5:
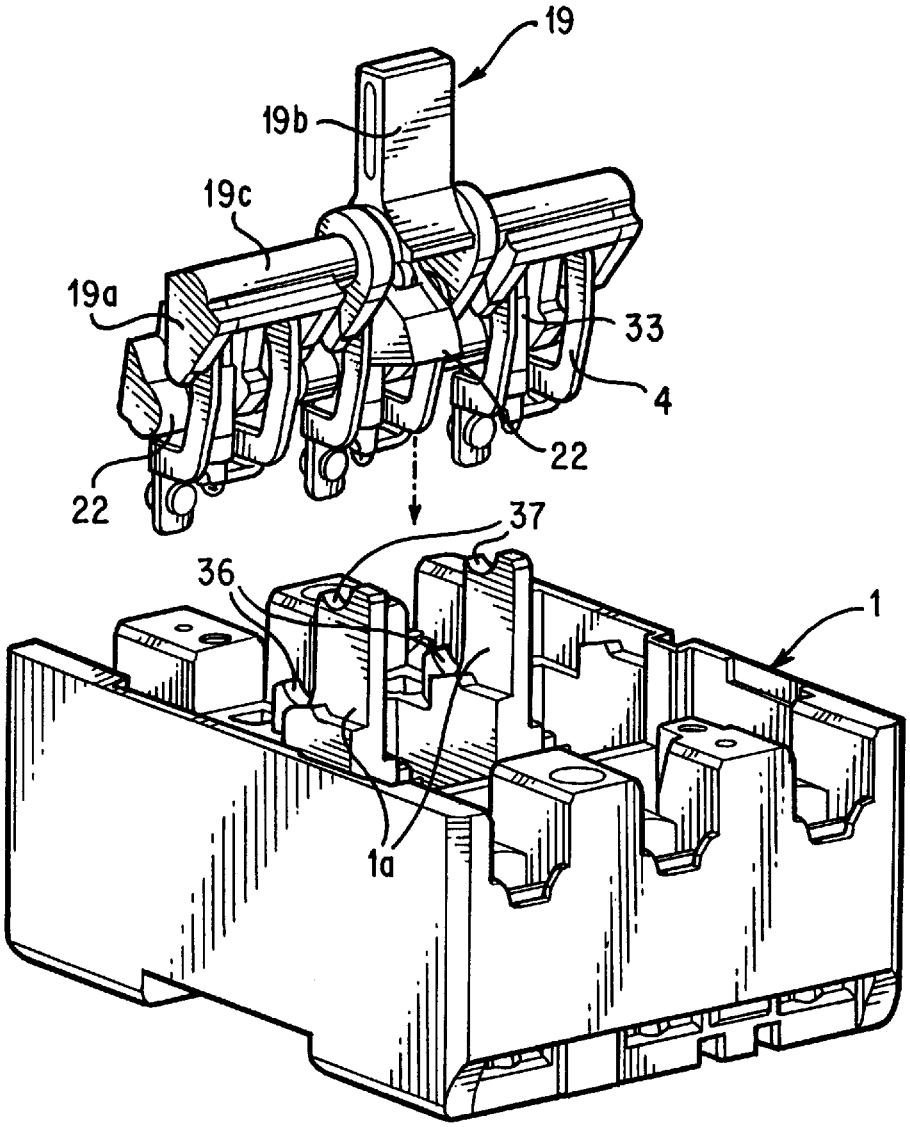
FIG. 5 is an exploded perspective view for showing a switch mechanism section and a case in the circuit breaker in FIG. 1.

The switch mechanism section formed of the movable contact 5, the handle 19, the latch 22 and the switch spring 33 is assembled as shown in FIG. 5 and integrally incorporated in the case 1. A lateral pair of plate-like bearing sections 1*a* is formed so as to integrally and vertically extend from the bottom of the case 1. Semi-circular bearing notches 36 and 37 are formed at two points in the top surfaces of the bearing sections 1*a* via a stage. The switch mechanism section is inserted into the case 1 along the arrow in FIG. 5, the latch 22 is supported by the bearing notch 36, and the handle 19 is supported by the bearing notch 37. On the other hand, the cover 2 includes similar bearing notches corresponding to the bearing notches 36 and 37, and the switch mechanism section is retained by screwing the cover 2 to the case 1 and contacting the bearing notches 36 and 37 with the bearing notches in the cover 2, in the final stage of the assembly.

Returning to FIG. 1, the latch 22 is subjected to a rotational force in the clockwise direction in the figure caused by the tension of the switch spring and held by the supporting shaft 22*a* as a supporting point, and the tip of the latch 22 is engaged with a latch receiver 34 and locked in the position shown in the figure. The latch receiver 34 is rotatably supported by the unit case 32 via an integrally formed protruding shaft 34*a*. The latch receiver 34 is subjected to a rotational force in the counterclockwise direction and held by the protruding shaft 34*a* as a supporting point, but is locked in the position shown in the figure by contacting a hook 34*b* with a claw 24*a* of a trip bar 24. The trip bar 24 molded with a resin comprises an insulating bar 24*b* traversing over each pole and having an integral tripping arm 24*c* opposed to the armature 27 for each pole. The trip bar 24 is rotatably supported by the unit case 32 at the insulating bar 24*b*. A return spring 35 formed of a tensile coil spring extends between the latch receiver 34 and the trip bar 24. The latch receiver 34 is urged in the clockwise direction in the figure, and the trip bar 24 is urged in the counterclockwise direction.

Figure 3:
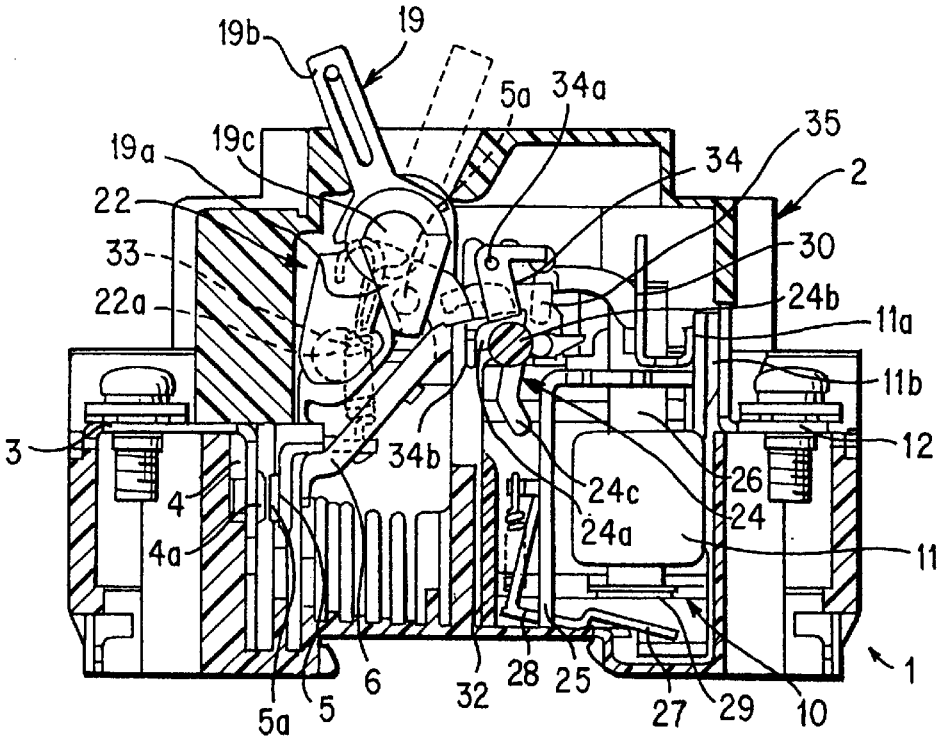
FIG. 3 is a vertical cross sectional view of a circuit breaker (wiring breaker) showing another embodiment of the invention.
Figure 4:
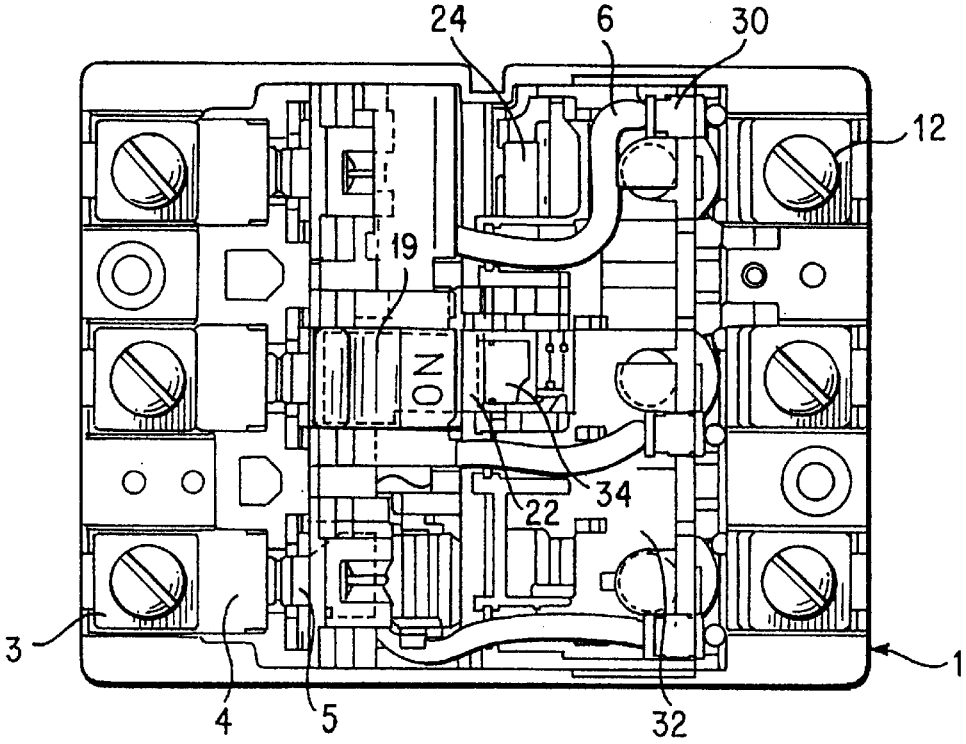
FIG. 4 is a plan view of the circuit breaker in FIG. 3.

FIG. 3 is a vertical cross sectional view at the "ON" state of a three-pole circuit breaker formed as a wiring breaker, wherein the earth leakage detection section is removed from the circuit breaker in FIGS. 1 and 2. FIG. 4 is a plan view of FIG. 3. This breaker is the same as the earth leakage breaker except that the ZCT 13, the print board 14, the primary conductor 31 and the tripping coil unit (not shown) are omitted, and that the lead 6 is directly coupled to the extension line 11*a* of the coil 11 via the relay terminal 30.

In FIG. 1 or 3, when the tip 19*b* of the handle 19 protruding from the cover 2 is rotated to the position shown by the broken line, the effects of the switch spring 33 on the movable contact 5 are reversed to drive the movable contact 5 in the counterclockwise direction, thereby causing it to leave the fixed contact 4 ("OFF" position). On the other hand, in an overcurrent state, the armature 27 of the overcurrent tripping device 10 is attracted to the electromagnetic pole 29, and presses the tripping arm 24*c* of the trip bar 24, thereby rotating the trip bar 24 in the clockwise direction in the figure. This disengages the claw 24*a* of the trip bar 24 from the hook 34*b* of the latch receiver 34, and the disengaged latch receiver 34 rotates in the counterclockwise direction in the figure. This releases the latch 22 locked by the latch receiver 34 to rotate in the clockwise direction in the figure, thereby reversing the effects of the movable contact 5 on the switch spring 33 to cause the movable contact 5 to leave the fixed contact 4, i.e. a tripping operation.

In FIG. 1, when leakage occurs to cause the main circuit current flowing through the primary conductor 31 to be unbalanced, a secondary output is generated by the ZCT 13 to cause the earth detection circuit mounted on the print board 14 to send out a tripping signal to the tripping coil unit (not shown), which drives the trip bar 24 to perform a similar tripping operation. The tripping coil unit is installed in a space 38 (FIG. 2) in the case 1 by cutting out the rightmost corner of the unit case 32 in an "L" shape, and acts on the tripping arm 24*c* constituting the right pole of the trip bar 24.

Figure 6:
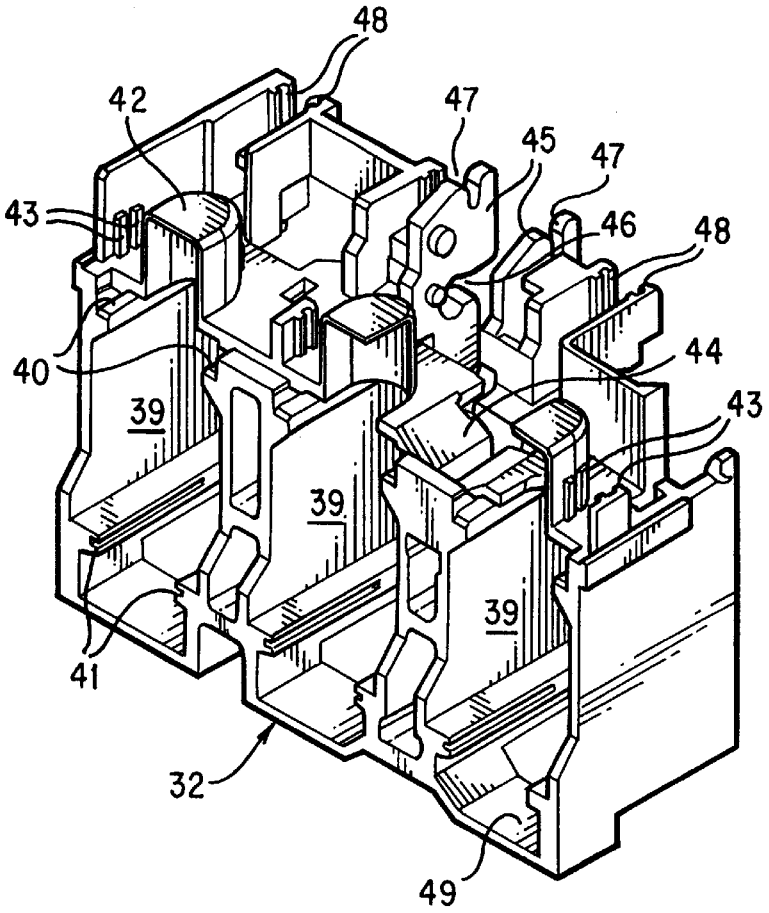
FIG. 6 is a perspective view for showing a unit case of an overcurrent tripping device in the circuit breaker in FIG. 1.

FIG. 6 is a perspective view for showing the unit case 32 from its load side (right of FIG. 1). The unit case 32 is integrally molded with a resin and includes an overcurrent tripping device housing space 39 for the three poles that are open toward the load side. A pair of grooves 40 and 41 with a C-shaped cross section opposed to each other is longitudinally formed at the top and bottom of lateral walls constituting each space. As described below, the yoke 22 of the overcurrent tripping device 10 is pressed and fixed in the groove 40 and the oil dash pot 26 is pressed and fixed in the groove 41. An insulating hood 42 with a U-shaped cross section is formed on each space 39 to house the end of the oil dash pot 26 opposed to the electromagnetic pole 29. A pair of grooves 43 that fit and hold the relay terminal 30 when the circuit breaker is formed as a wiring breaker is vertically formed on one side of each of the insulating hoods 42 and on a surface of each of the vertical walls opposite the insulating hoods 42.

In FIG. 6, a recess 44 with a curved surface on which the ZCT 13 is mounted is formed in the top surface of the unit case 32 between the insulating hood 42 for the central pole and the insulating hood 42 for the right pole. At the same time, a pair of vertical supporting plates 45 that supports the trip bar 24 and the latch receiver 34 is formed on the power side (right of FIG. 6) of the unit case 32. A key hole-like bearing notch 46 supporting the trip bar 24 is formed in the front end surface of each supporting plate 45, and a U-shaped bearing notch 47 supporting the latch receiver 34 is formed in the upper end surface of each supporting plate 45. Furthermore, a pair of grooves 48 that fit and hold the relay terminal 30 when the circuit breaker is formed as an earth leakage breaker is vertically formed on the power side of the upper part of the unit case 32 along the opposed surfaces of the pair of the vertical walls which is formed in three positions of the unit case. A bottom plate 49 of the space 39 constitutes a stopper for regulating the attraction stroke of the armature 27 of the overcurrent tripping device 10 as described below.

Figure 7:
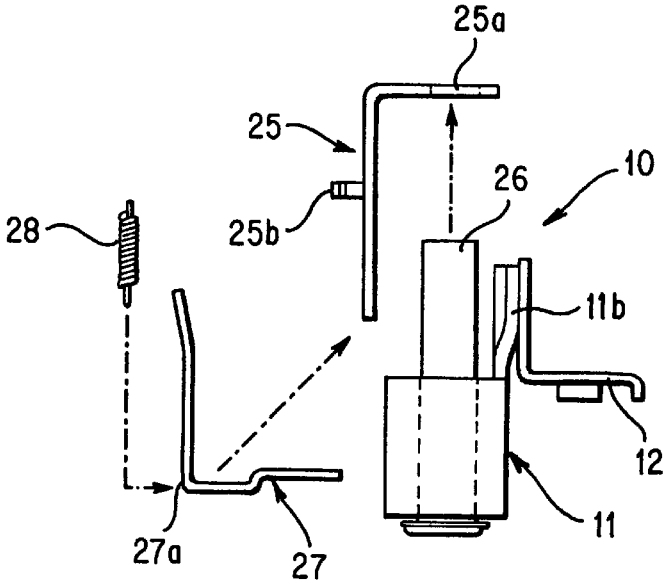
FIG. 7 is an exploded side view of the overcurrent tripping device in the circuit breaker in FIG. 1.
Figure 8:
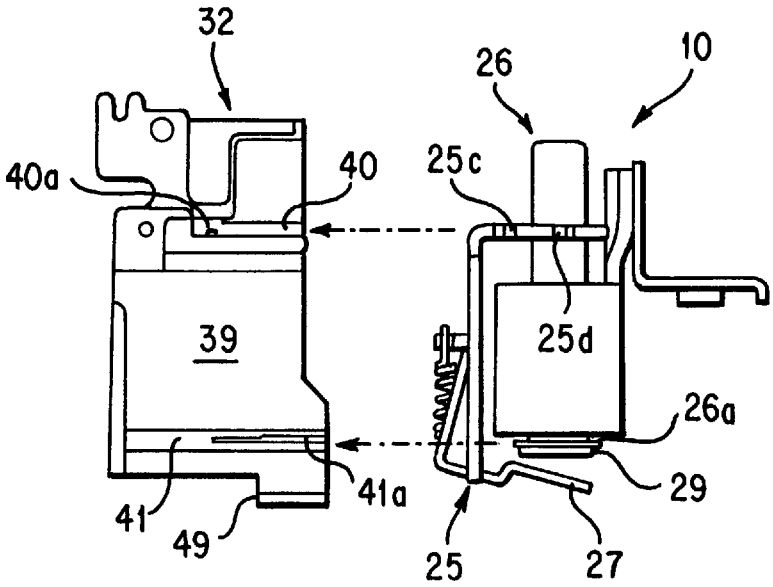
FIG. 8 is a vertical cross sectional view of the unit case in FIG. 6 and a side view of the overcurrent tripping device in FIG. 7 when they are assembled.
Figure 13:
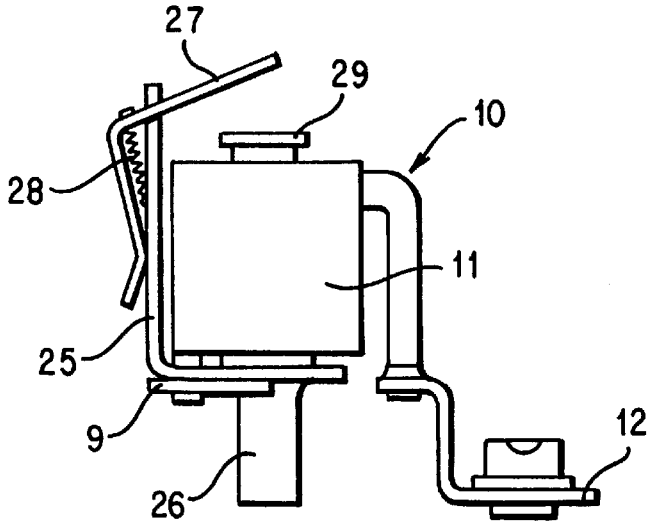
FIG. 13 PRIOR ART
FIG. 13 is an enlarged side view of an overcurrent tripping device in the circuit breaker in FIG. 12.

FIG. 7 is an exploded side view of the overcurrent tripping device 10. FIG. 7 shows the device 10 arranged upside down relative to the device in FIG. 13, but this device substantially has the same structure as the overcurrent tripping device 10 in FIG. 13. The oil dash pot 26 that is combined with the yoke 25, however, is only inserted into a penetration hole 25*a* in one leg of the yoke 25 but not soldered thereto. In this case, the load terminal 12 is connected to the extension line 11*b* from the coil 11 by spot welding. Before the overcurrent tripping device 10 is housed in the unit case 32, the oil dash pot 26 inserted into the coil 11 is inserted into the penetration hole 25*a* in the yoke 25, the armature 27 is fitted to the tip of the other leg of the yoke 25, and both ends of the return spring 28 are bent so as to be caught at spring receiving pieces 25*b* and 27*a* formed on the yoke 25 and the armature 27, respectively, in order to assemble the device as shown in FIG. 8. As shown in the side view of FIG. 8, the leg of the yoke 25 overlaps the end of the armature 27, and a window hole for passing the end of the armature 27 is formed in this part of the leg of the yoke 25.

FIG. 8 is a vertical cross sectional view for showing the unit case 32 into which the overcurrent tripping device 10 is inserted in the direction shown by the arrow. A U-shaped notch 25*c* and an angle protrusion 25*d* are formed side by side in the lateral end surfaces of the leg of the yoke 25, into which the oil dash pot 26 has been inserted, and a semi-spherical protrusion 40*a* is formed on the bottom surface of the groove 40 of the unit case 32 so as to correspond to the notch 25*c*. The width between the tops of the lateral protrusions 25*d* is somewhat larger than that between the opposed surfaces of the lateral grooves 40. In addition, an annular flange 26*a* is integrally formed on the head of the oil dash pot 26 to receive the electromagnetic pole 29, and a slit-like groove 41*a* with a two-level width that is somewhat smaller than the thickness of the flange 26*a* toward the inside so as to correspond to the flange 26*a* is formed in the side of the groove 41 in the unit case 32.

The overcurrent tripping device 10 is horizontally inserted into the space 39 of the unit case 32 from the load side, and the protrusions 25*d* of the yoke 25 are pressed in the grooves 40 to fit the notch 25*c* on the protrusion 40*a*. This allows the yoke 25 to be positioned and fixed in the unit case 32. At the same time, the flange 26*a* of the oil dash pot 26 is pressed in the grooves 41 until it reaches the deepest part of the grooves 41. This allows the oil dash pot to be positioned and fixed in the unit case 32. In this state, the inter-locational relationship between the yoke 25 and the oil dash pot 26 is defined and fixed. In addition, the end of the armature 27 contacts the bottom plate 49 of the unit case 32 to regulate the attraction stroke or gap between the armature 27 and the electromagnetic pole 29.

Figure 9:
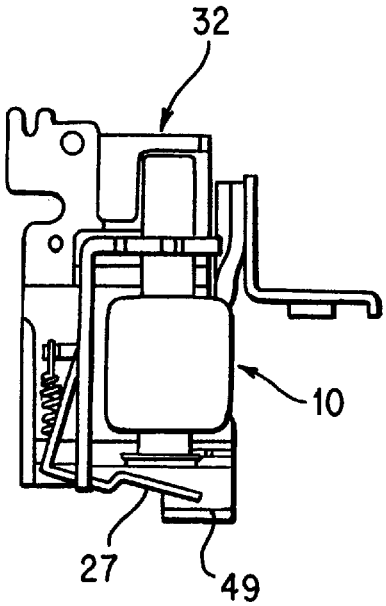
FIG. 9 is a vertical cross sectional view of the unit case in which the overcurrent tripping device in FIG. 8 is housed.

FIG. 9 shows a vertical cross sectional view of the unit case 32 housing the overcurrent device 10. The unit case 32 is inserted into the load side of the case 1 shown in FIG. 5, and positioned and fixed in the case 1 as shown in FIG. 2 or 4, with the upper end surface of the side wall pressed and fixed by the cover 2.

Figure 10:
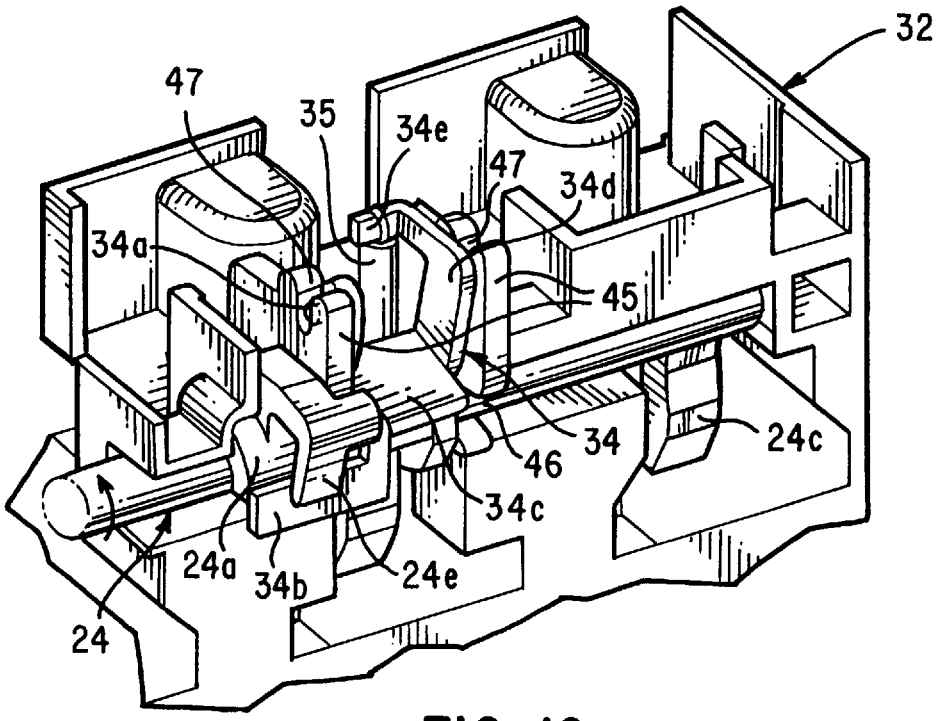
FIG. 10 is a perspective view of the integral part of the unit case supporting a trip bar and a latch receiver as seen from the side opposite to that in FIG. 6.
Figure 11:
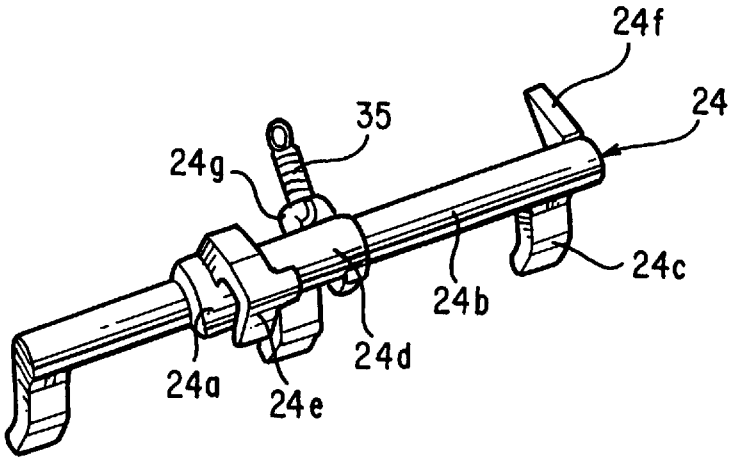
FIG. 11 is a perspective view of the trip bar in FIG. 10.
Figure 12:
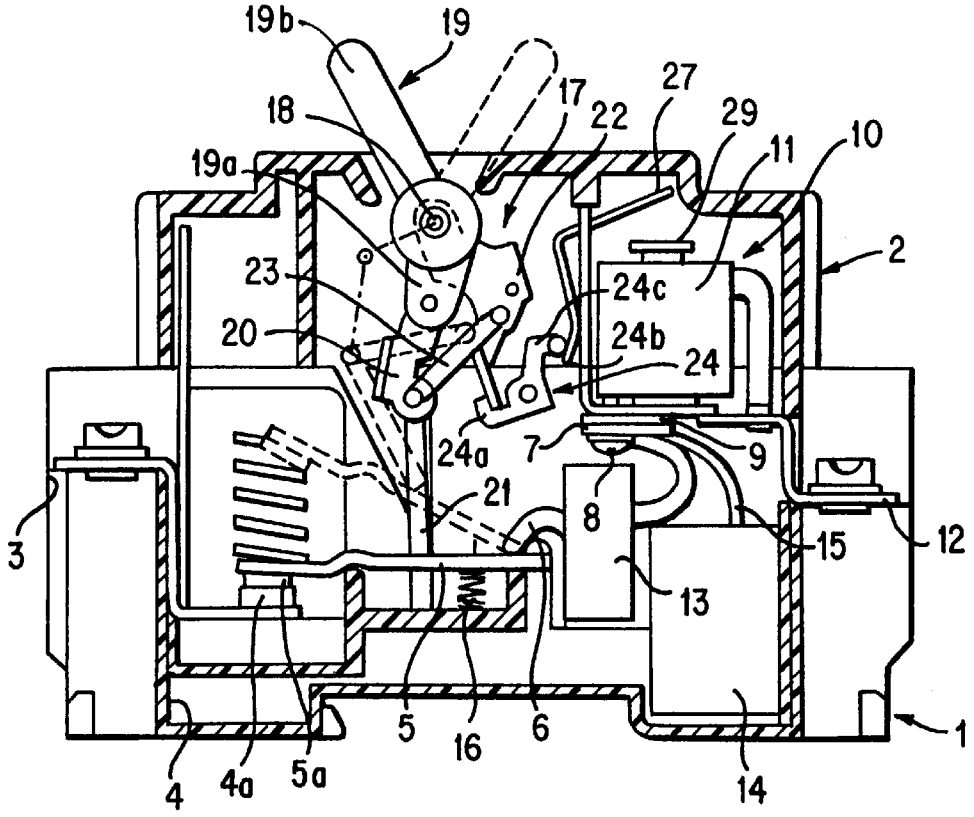
FIG. 12 PRIOR ART
FIG. 12 is a vertical cross sectional view of a conventional circuit breaker.

FIG. 10 is a perspective view for showing the integral part of the unit case 32 from the side opposite to that shown in FIG. 6 (power side), wherein the unit case 32 supports the trip bar 24 and the latch receiver 34, and FIG. 11 is a perspective view for showing the trip bar 24, at which one end of the return spring 35 is caught. In the trip bar 24 in FIG. 11, the insulating bar 24*b* includes the tripping arms 24*c* for the respective poles; and a large diameter portion 24*d* of a specified width disposed in the center thereof and including at one end the claw 24*a* formed of a fan-like protrusion, via a gap corresponding to the thickness of the supporting plate 45 of the unit case 32. A key-like stopper piece 24*e* having effects described below is integrally formed on the claw 24*a*. An arm section 24*f* formed at one end of the insulating bar 24*b* so as to protrude in the direction orthogonal to the tripping arm 24*c* abuts against a manual trip button to be pressed (not shown) to rotate the trip bar 24.

A spring catching piece 24*g* bent like a key along the axial direction is integrally formed at the central pole section of the insulating bar 24*b*. One end of the return spring 35 is caught at the spring catching piece 24*g* as shown in FIG. 11. The trip bar 24 with the return spring 35 held at one end is inserted into the bearing notches 46 of the unit case 32 and supported as shown in FIG. 10. In this case, the large diameter portion 24*d* of the insulating bar 24*b* is sandwiched between the lateral supporting plates 45 to axially position the insulating bar 24*b*. The left supporting plate 45 is placed in the gap between the large diameter portion 24*d* and the claw 24*a*. Although not shown, small diameter portions are formed in the insulating bar 24*b* to be supported by the bearing notches 46 (both sides of the large diameter portion 24*d*) cutting two surfaces of the outer circumference while keeping them flat. The trip bar 24, which has been inserted via the small diameter portions into the bearing notches 46 with narrow inlets, is rotated at 90 degrees to prevent removal therefrom.

The latch receiver 34 of a steel plate includes supporting arms 34*d* on both sides of a square engagement section 34*c*, and protruding shafts 34*a* are formed at the tip of the respective supporting arms 34*d* so as to protrude outwardly. A spring catching piece 34*e* is formed at the tip of one of the supporting arms 34*d* by being bent like a key shape, and a hook 34*b* is formed at the front end of the engagement piece 34*c* so as to extend laterally. The latch receiver 34 is supported as shown in FIG. 10 with the protruding shafts 34*a* inserted into the bearing notches 47 and with the hook 34*b* accommodated inside the stopper piece 24*e* of the trip bar 24. The other end of the return spring 35, one end of which has been caught at the trip bar 24, is caught at the spring catching piece 34*e*, so that the tension of the return spring 35 serves to hold the protruding shaft 34*a* to prevent it from slipping out from the bearing notch 46, while the hook 34*b* simultaneously contacts the stopper piece 24*e* of the trip bar 24 to counteract the rotational force caused by the tension.

In this state, the hook 34*b* is opposed to the circular surface of the claw 24*a*. When the latch 22 is engaged with the engagement section 34*c*, the hook 34*b* contacts the circular surface of the claw 24*a* to lock the latch receiver 34. As described above, when the tripping bar 24*c* of the trip bar 24 is pressed by the armature 27 of the overcurrent tripping device 10 to rotate the trip bar 24 in the direction shown by the arrow in FIG. 10, the hook 34*b* is removed from the claw 24*a* to rotate the latch receiver 34, thereby releasing the latch 22 locked by the latch receiver 34 to trip the circuit breaker.

Again in FIGS. 1 and 2, to connect the main circuit conductor to the top of the unit case 32 as shown in the figures after the overcurrent tripping device 10 has been housed and the unit case 32 supporting the trip bar 24 and the latch receiver 34 has been inserted into the case 1, the relay terminal 30 spot-welded to the lead 6 is pressed and held in the grooves 48 (FIG. 6) in the unit case 32 from above the unit case. The relay terminal 30 is a J-shaped conductive fixture with two long and short leg sections bent longitudinally, and the side edges of the long leg section that somewhat extends laterally are pressed in the grooves 48. The ZCT 13, through which the primary conductor 31 has been allowed to penetrate, is placed on the recess 44 (FIG. 6) in the unit case 32, and one end of the primary conductor 31 is joined with the short leg portion of the relay terminal 30 by spot welding, while the other end is joined with the extension line 11*a* from the coil 11 by spot welding. The primary conductor 31 comprises a single wire, and the left and central poles are molded like the character "C", and the right pole is bent like the character "L", as shown in FIG. 2.

The print board 14 incorporating the earth leakage breaker that detects leakage from a secondary output from the ZCT 13 to output a tripping signal is accommodated in a print board case 50 (FIG. 1), which is disposed on the top surface of the unit case 32. The print board 14 and the print board case 50 are omitted in FIG. 2, but are square in a plan view and extend over both the right and left poles of the circuit breaker. Those portions of the print board 14 and the print board case 50 which correspond to the supporting plates 45 of the unit case 32 are cut out. The long legs of the vertical relay terminals 30 constituting the right and left poles penetrate through the print board 14, are soldered and electrically connected to the power terminal section of the print board 14, and mechanically hold the print board 14. That is, the relay terminal 30 also acts as a power line for the print board 14. The tip of the long leg section of the relay terminal 30 which is inserted into the print plate 14 is formed like a rod.

In the wiring breaker in FIGS. 3 and 4, the relay terminal 30 connected to the lead 6 is pressed and held in the grooves 43 in the unit case 32, and its short leg section is joined with the extension line 11*a* from the coil 11 by spot welding.

This invention provides the following effects.

(1) Since the yoke and oil dash pot of the overcurrent tripping device for each pole are pressed and fixed in the unit case, the need to couple the yoke and the oil dash pot together by soldering is eliminated. This enables the yokes and oil dash pots to be separately stored prior to assembly and also enables flexible responses to changes according to the production schedule, i.e. the number of different overcurrent tripping devices for different rated currents can be produced. It also reduces the soldering operation and thus the number of assembly operations.

(2) Since the overcurrent tripping device for each pole is integrally housed in the unit case, which is then incorporated in the case of the circuit breaker, the number of assembly operations can be reduced as compared to the conventional method in which the overcurrent tripping device must be screwed and fixed into place for each pole.

(3) In this case, the latch receiver for locking the latch for the switch mechanism and the trip bar for locking the latch receiver are supported by the unit case, which also supports the overcurrent tripping device. This improves the locational accuracy of the overcurrent tripping device between the armature and the trip bar and between the claw of the trip bar and the latch receiver, thereby improving the tripping characteristic of the overcurrent tripping device.

(4) Since the main circuit conductor is disposed on the unit case of the overcurrent tripping device, it can be connected to the overcurrent tripping device from above the top surface of the case of the circuit breaker. This improves workability and enables easier spot soldering within an assembly line. It also enables the power line to be connected easily to the earth leakage detection circuit.

(5) One end of the lead is connected to the movable contact, while the other end is connected to the relay terminal, which is fitted and held in the unit case of the overcurrent tripping device. Thus, the position of a connecting end of the flexible lead which is connected to one end of the coil of the overcurrent tripping device or one end of the main circuit conductor which penetrates through the ZCT is stable, thereby allowing connecting operations, such as spot welding, to be executed easily.

(6) Since a part of the relay terminal is directly coupled to the power terminal section of the print board with the earth leakage detection circuit mounted thereon, the need for a separate power line that connects the main circuit and the power terminal together is eliminated and the print board can be mechanically retained by the relay terminal.

What is claimed is:

1. A circuit breaker, comprising:

a molded container having a case and a cover disposed above the case, said case having, on an upper portion, handle supporting portions and latch supporting portions, and a unit case receiving space therein, a switch mechanism having a handle, movable contacts for respective poles and a latch assembled together as one unit, said handle being disposed on the handle supporting portions and the latch being disposed on the latch supporting portions when the switch mechanism is assembled with the case, overcurrent tripping devices for the respective poles acting on the latch for the switch mechanism to cause a tripping operation, each of said overcurrent tripping devices having a coil, an oil dash pot inserted into the coil, and an L-shaped yoke engaging the oil dash pot, a unit case for individually housing said overcurrent tripping devices, said yoke and oil dash pot of each overcurrent tripping device assembled with the coil being pressed into the unit case in an assembled condition, said unit case containing the overcurrent tripping devices for the respective poles being inserted into the unit case receiving space of the container when the circuit breaker is assembled, and a main circuit conductor having relay terminals and leads disposed on the unit case so that the main circuit conductor can be easily assembled.

2. A circuit breaker according to claim 1, wherein said overcurrent tripping device further includes an armature supported by the yoke, and a return spring situated between the yoke and the armature.

3. A circuit breaker according to claim 1, further comprising a latch receiver for locking said latch and a trip bar engaging the latch receiver, said unit case supporting the latch receiver and the trip bar.

4. A circuit breaker according to claim 1, wherein said switching mechanism includes in each pole the movable contact, a lead connected to the movable contact at one end, and a relay terminal connected to the other end of the lead, said relay terminal being fitted and retained in said unit case.

5. A circuit breaker according to claim 4, further comprising a print board having a power terminal and an earth leakage detection circuit mounted thereon, said power terminal being directly connected said relay terminal.

6. A circuit breaker according to claim 3, wherein said unit case further includes supporting plates at an upper side near the switch mechanism having latch receiver supporting portions and trip bar supporting portions, said latch receiver being disposed in the latch receiver supporting portions and said trip bar being disposed in the trip bar supporting portions.

7. A circuit breaker according to claim 1, wherein said unit case includes overcurrent tripping device housing spaces, which open at one side of the unit case for housing each of the overcurrent tripping devices, and grooves communicating with the overcurrent tripping device housing spaces, respectively, for holding the yokes and oil dash pots.

8. A circuit breaker according to claim 7, wherein said main circuit conductor further includes a ZCT situated on the unit case, and primary conductors passing through the ZCT, each primary conductor being connected to the relay terminal and the coil of the overcurrent tripping device.

* * * * *

UNITED STATES PATENT AND TRADEMARK OFFICE

CERTIFICATE OF CORRECTION

PATENT NO. : 5,874,877

DATED : February 23, 1999

INVENTOR(S) : Yoshiaki Kawashima, Kazuhiko Satoh, Tadahisa Aoki, Makoto Ogasawara It is certified that error appears in the above-indentified patent and that said Letters Patent is hereby corrected as shown below:

In column 6, line 61, after "opposite" add --to--;

In column 7, line 11, after "walls" add comma;

In column 8, line 67, change "bar" (first occurrence) to --arms--; and

In column 11, line 7, after "connected" add --to--.

Signed and Sealed this

Twenty-seventh Day of July, 1999

*Attest:*

Q. TODD DICKINSON

*Attesting Officer*

*Acting Commissioner of Patents and Trademarks*